US010782005B2

(12) United States Patent
Guerra et al.

(10) Patent No.: US 10,782,005 B2
(45) Date of Patent: Sep. 22, 2020

(54) COUPLER FOR LIGHT FIXTURE

(71) Applicant: Hubbell Incorporated, Shelton, CT (US)

(72) Inventors: George Guerra, Chino Hills, CA (US); Kevin Lu, Fountain Valley, CA (US); Syed Raza, Rancho Palos Verdes, CA (US); Dean Dal Ponte, Glendale, CA (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 16/204,715

(22) Filed: Nov. 29, 2018

(65) Prior Publication Data

US 2019/0162394 A1 May 30, 2019

Related U.S. Application Data

(60) Provisional application No. 62/592,898, filed on Nov. 30, 2017.

(51) Int. Cl.

| | |
|---|---|
| ***F21V 21/005*** | (2006.01) |
| ***F21V 15/015*** | (2006.01) |
| ***F21V 23/06*** | (2006.01) |

(52) U.S. Cl.

CPC ..... *F21V 21/005* (2013.01); *F21V 15/015* (2013.01); *F21V 23/06* (2013.01)

(58) Field of Classification Search

CPC ..... F21V 21/005; F21V 15/015; F21V 23/06

See application file for complete search history.

(56) References Cited

U.S. PATENT DOCUMENTS

| | | | |
|---|---|---|---|
| D295,086 | S | 4/1988 | Morten |
| D397,818 | S | 9/1998 | Herst |
| D502,565 | S | 3/2005 | Hetfield |
| D580,583 | S | 11/2008 | Pfund |
| D603,548 | S | 11/2009 | Pei |
| D610,293 | S | 2/2010 | Klaus |
| D624,229 | S | 9/2010 | Adolph |
| D629,554 | S | 12/2010 | Gielen |
| D727,551 | S | 4/2015 | Clark |
| D735,392 | S | 7/2015 | Ng |
| D756,553 | S | 5/2016 | Kim |
| D766,487 | S | 9/2016 | Cai |
| D775,395 | S | 12/2016 | Huyghe |
| D791,998 | S | 7/2017 | Lonsdale |
| D794,241 | S | 8/2017 | Huyghe |
| D808,566 | S | 1/2018 | Goetz-Schaefer |
| D825,815 | S | 8/2018 | Sonneman |
| D847,395 | S | 4/2019 | Tremaine |
| 2004/0090778 | A1 | 5/2004 | Noh |

(Continued)

OTHER PUBLICATIONS

PCT/US2018/063076 International Search Report and Written Opinion dated Feb. 15, 2019 (13 pages).

*Primary Examiner* — Anabel Ton

(74) *Attorney, Agent, or Firm* — Michael Best & Friedrich, LLP

(57) ABSTRACT

A bracket for a luminaire includes a first planar portion and a second planar portion. The first planar portion includes an aperture with an inclined surface. The second planar portion extends parallel to the first planar portion. The second planar portion also includes an aperture with an inclined surface.

20 Claims, 7 Drawing Sheets

(56) References Cited

U.S. PATENT DOCUMENTS

| | | | | |
|---|---|---|---|---|
| 2007/0153550 | A1 | 7/2007 | Lehman et al. | |
| 2011/0310604 | A1* | 12/2011 | Shimizu | F21V 15/015 362/235 |
| 2012/0243217 | A1 | 9/2012 | Szprengiel et al. | |
| 2015/0008473 | A1* | 1/2015 | Lee | H01L 33/642 257/99 |
| 2016/0363300 | A1 | 12/2016 | Ma | |
| 2017/0307152 | A1 | 10/2017 | Patel et al. | |

* cited by examiner

COUPLER FOR LIGHT FIXTURE

CROSS-REFERENCE TO RELATED APPLICATION

This application claims the benefit of prior-filed U.S. Provisional Patent Application No. 62/592,898, filed Nov. 30, 2017, the entire contents of which are incorporated by reference.

BACKGROUND

The present disclosure relates to light fixtures, and more specifically to a bracket that is removably coupled to a light fixture.

SUMMARY

In one independent aspect, a bracket is removably connectable to a housing of a luminaire. The bracket includes a first planar portion, a second planar portion, and an intermediate portion coupled between the first planar portion and the second planar portion. The first planar portion includes at least one first aperture, and the first aperture is enclosed within a first peripheral edge. An oblique portion of the first peripheral edge is oriented at an oblique angle relative to at least one other portion of the first peripheral edge. The second planar portion is parallel to the first planar portion. The second planar portion includes at least one second aperture, and the second aperture is enclosed within a second peripheral edge. An oblique portion of the second peripheral edge is oriented at an oblique angle relative to at least one other portion of the second peripheral edge.

In another independent aspect, a luminaire includes a housing, a bracket, a projection, and an aperture. The housing includes an end and an inner surface. The bracket is positioned adjacent the end of the housing. The projection is positioned on one of the inner surface of the housing and the bracket. The aperture is positioned on the other of the inner surface of the housing and the bracket. The aperture receives the projection, and the aperture is enclosed within a peripheral edge. An oblique portion of the peripheral edge is oriented at an oblique angle relative to at least one other portion of the peripheral edge. The oblique portion engages the projection to bias the bracket toward the end of the housing.

Other aspects of the disclosure will become apparent by consideration of the detailed description and accompanying drawings.

DETAILED DESCRIPTION

Figure 1:
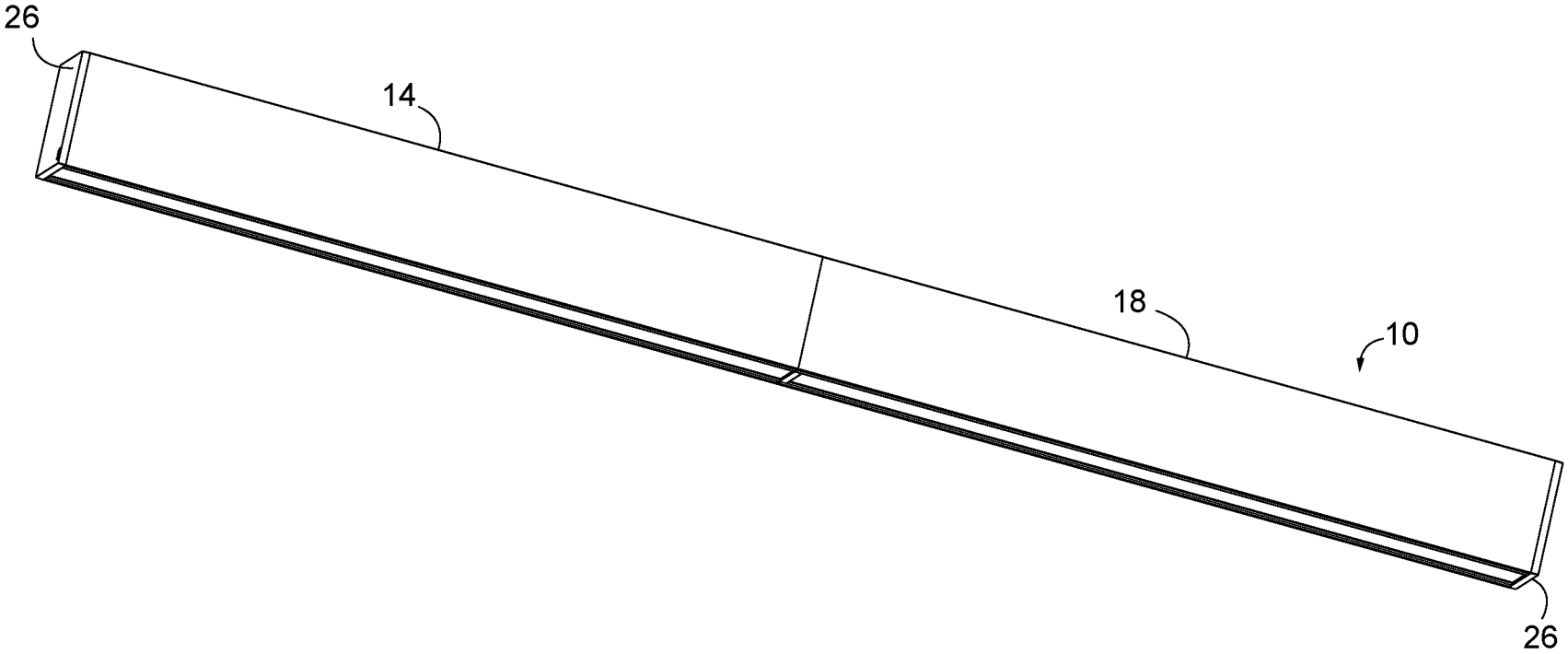
FIG. 1 is a perspective view of a luminaire housing.
Figure 2:
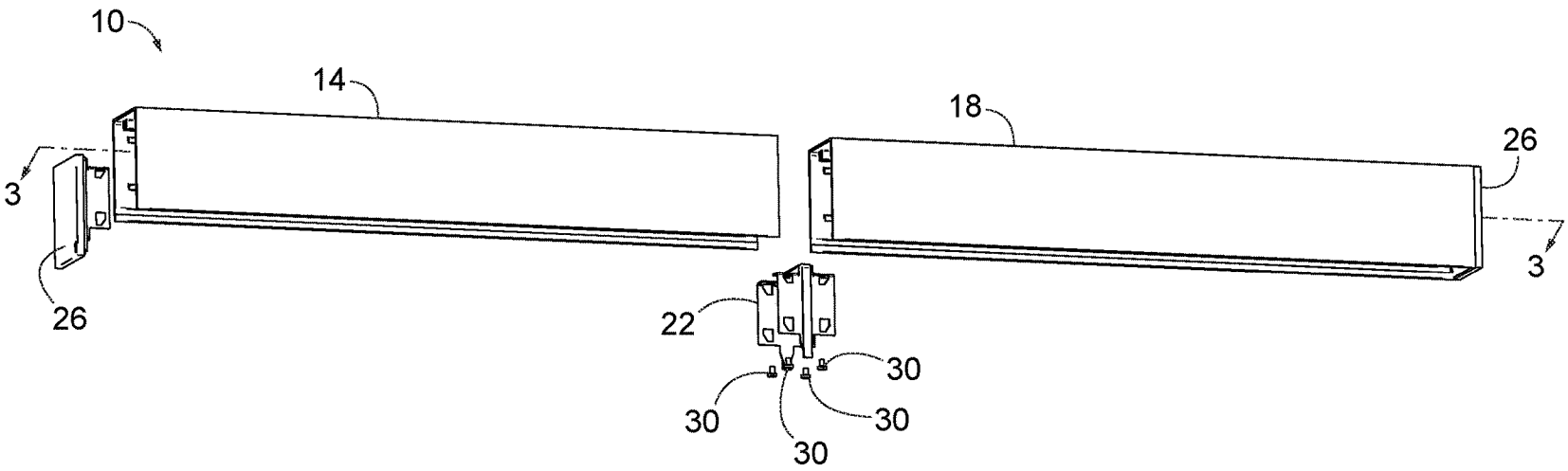
FIG. 2 is an exploded view of the luminaire housing of FIG. 1.

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Unless specified or limited otherwise, the terms "mounted," "connected," "supported," and "coupled" and variations thereof are used broadly and encompass both direct and indirect mountings, connections, supports, and couplings.

In general, the present disclosure relates to a coupler, such as a bracket, for connecting a luminaire housing to other components, such as another luminaire housing or to an end cover. The coupler provides a visibly continuous surface between the luminaire housing and the connected component.

As shown in FIGS. 1-5, a light fixture (e.g., a luminaire 10) includes a first housing 14 and a second housing 18. In the illustrated embodiment, the housings 14, 18 have substantially the same length, are arranged in an end-to-end relationship, and have a rectangular transverse cross-section. In other embodiments, the housings may have different lengths, may be positioned in a different manner, and/or the housing profile may be another shape. Also, in the illustrated embodiment, the luminaire 10 includes a first coupler or intermediate coupler or central bracket 22 and second couplers or end brackets 26. The central bracket 22 is positioned between adjacent, facing ends of the first housing 14 and the second housing 18. Fastening members 30 couple the central bracket 22 to the housings 14, 18. Each end bracket 26 is positioned adjacent a distal end of the first housing 14 or the second housing 18. A plurality of fastening members (not shown) couple the end bracket 26 to the associated end of the first housing 14 or the second housing 18.

Figure 8:
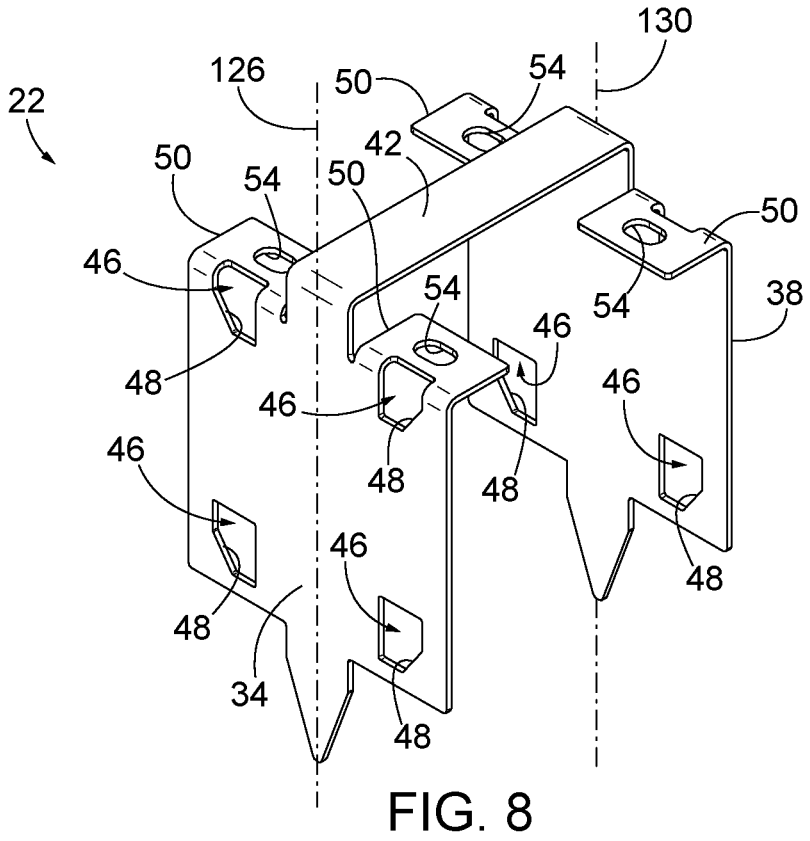
FIG. 8 is a perspective view of an intermediate coupler.

As shown in FIG. 8, the central bracket 22 has a first planar extension or first face 34 and a second planar extension or second face 38. The faces 34, 38 are parallel to one another and are substantially rectangular in shape, although in other embodiments, the faces 34, 38 may be another shape. The first face 34 and the second face 38 are connected by a bar 42 that is integrally formed with the faces 34, 38. The bar 42 is positioned above the faces 34, 38 and a space between the faces 34, 38 is open.

Each face 34, 38 includes four apertures 46. In other embodiments, the faces 34, 38 may include fewer or more apertures. In the illustrated embodiment, the apertures 46 are positioned proximate corners of the first face 34 and the second face 38. Each aperture 46 is at least partially enclosed by a peripheral edge, and a portion of the peripheral edge includes an inclined surface 48. In the illustrated embodiment, the inclined surfaces 48 slope downwardly, away from the bar 42 and away from the axis of insertion of the projections 122. Each inclined surface 48 slopes from an edge of the face 34, 38 proximate the aperture 46 and parallel to a first face axis 126 and a second face axis 130, toward the first or second axes 126, 130 and forms an oblique angle relative to the adjacent portions of the peripheral edge. In the illustrated embodiment, the oblique angle is between 0° and 90°, and the oblique portion of the peripheral edge is neither parallel nor perpendicular relative to the adjacent portions of the peripheral edge, and is neither parallel nor perpendicular relative to the face axes 126, 130. Each face 34, 38 is symmetric about the respective axis 126, 130.

Bent portions 50 are positioned adjacent an edge of each face 34, 38. The bent portions 50 are formed integrally with and positioned at corners of the faces 34, 38. In the illustrated embodiment, the bent portions 50 are formed proximate the bar 42, with a single bent portion 50 positioned on either side of the bar 42. The bent portions 50 are oriented orthogonally to the faces 34, 38 and extend towards the opposite face 34, 38. In other words, the bent portions 50 on the first face 34 extends towards the second face 38 and the bent portions 50 on the second face 38 extends towards the first face 34. Each bent portion 50 has one hole 54, although in other embodiments, the bent portions 50 may include more holes 54.

Figure 9:
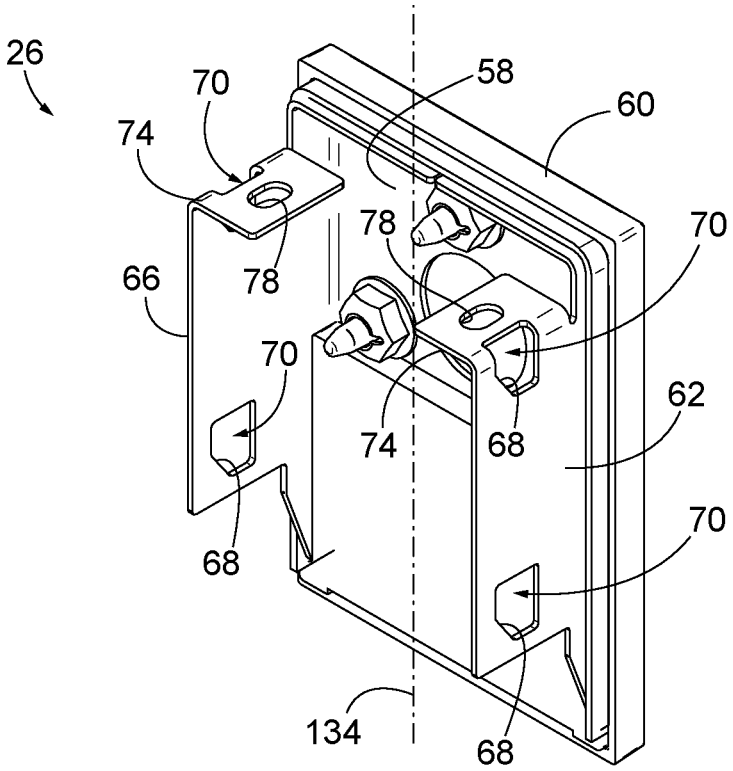
FIG. 9 is a perspective view of an end coupler.

As shown in FIG. 9, each end bracket 26 includes an end surface 58 and a top surface 60 orthogonal to the end surface 58. In the illustrated embodiment, the end surface 58 is rectangular in shape, although in other embodiments, the end surface 58 may have a different shape. A first planar portion or first side face 62 and a second planar portion or second side face 66 are integrally formed on the end surface 58 and extend orthogonally away from the end surface 58. The side faces 62, 66 are generally rectangular in shape.

In the illustrated embodiment, each side face 62, 66 includes two apertures 70. One aperture 70 is positioned on either end of each side face 62, 66, although in other embodiments, the apertures 70 may be positioned elsewhere on the side faces 62, 66. Each aperture 70 includes a peripheral edge having an oblique or inclined portion or surface 68. In the illustrated embodiment, the inclined surfaces 68 slope downwardly, away from the top surface 60. Each inclined surface 68 slopes from an edge of the face 62, 66 distal the end surface 58 and parallel to an end face or end bracket axis 134, toward the end bracket axis 134. In the illustrated embodiment, the oblique angle is between 0° and 90°, and the oblique portion of the peripheral edge is neither parallel nor perpendicular relative to the adjacent portions of the peripheral edge, and is neither parallel nor perpendicular relative to the face axes 126, 130. The apertures 70 on the first side face 62 are mirrors of the apertures 70 on the second side face 66 about the end bracket axis 134.

A bent section 74 is positioned adjacent an edge of the side face 62, and another bent section 74 is positioned adjacent an edge of the side face 66. The bent sections 74 are formed integrally with and positioned at an end of the side faces 62, 66. In the illustrated embodiment, the bent sections 74 are formed proximate the top surface 60. The bent sections 74 are oriented orthogonally to the side faces 62, 66 and extend towards the opposite side face 62, 66. In other words, the bent sections 74 on the first side face 62 and the bent sections 74 on the second side face 66 each extend towards the end bracket axis 134. Each bent section 74 has one hole 78, although in other embodiments, the bent sections 74 may include more holes 78.

Figure 3:
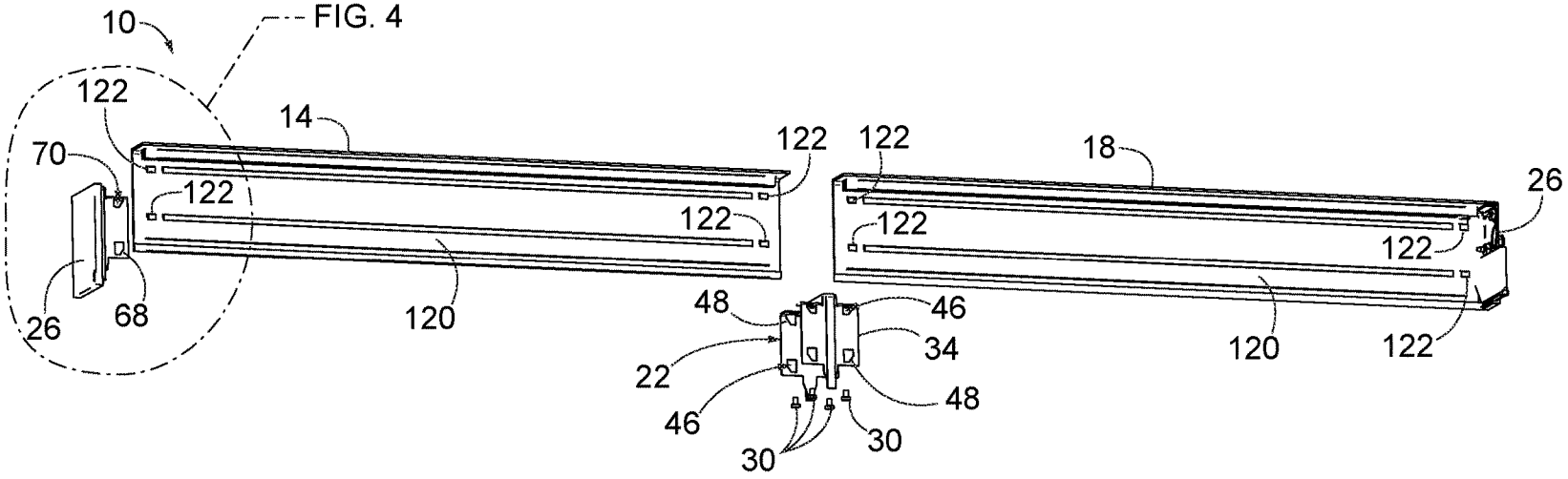
FIG. 3 is a cross-sectional view of the luminaire housing of FIG. 2 viewed along section 3-3.
Figure 4:
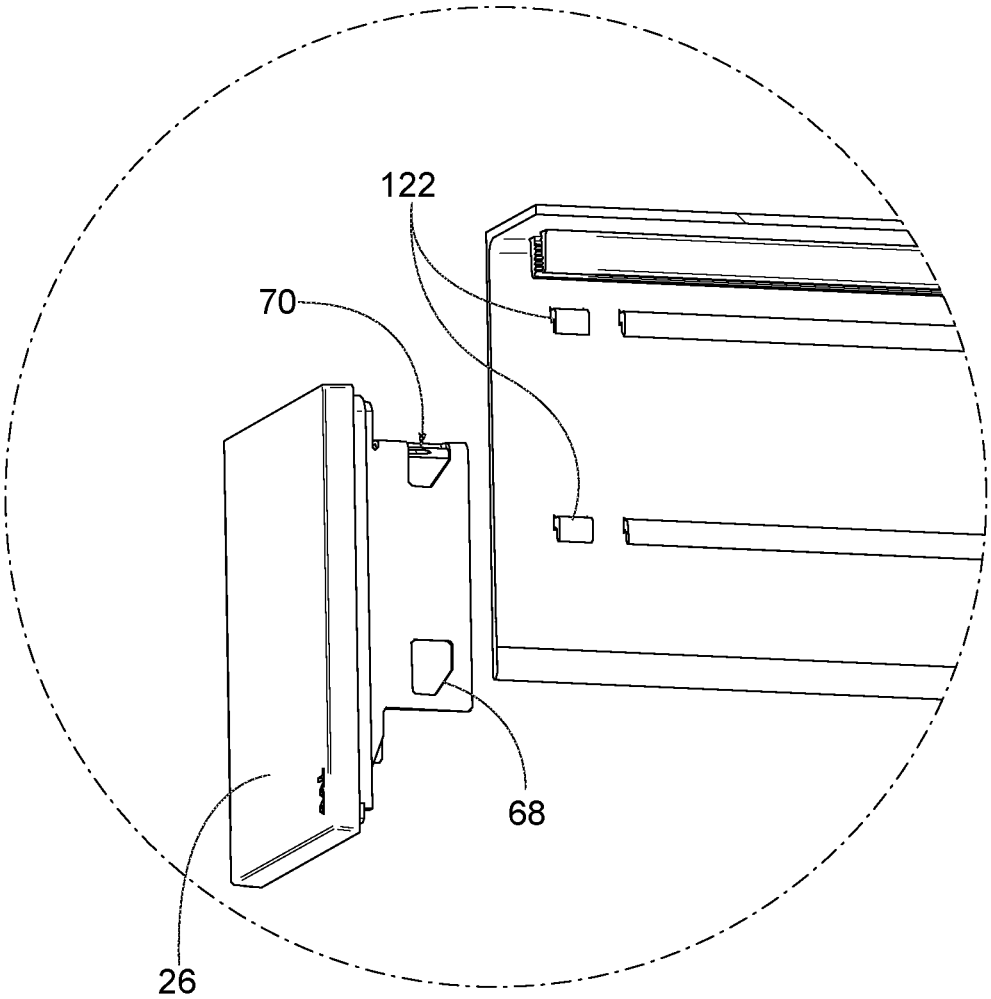
FIG. 4 is an enlarged view of a portion of the luminaire housing of FIG. 3.

Referring now to FIG. 3, an inner surface 120 of the first housing 14 and the second housing 18 include a plurality of projections or hooks 122. In the illustrated embodiment, each housing 14, 18 has eight hooks 122, four hooks 122 on each end. One hook 122 is positioned proximate each corner of each housing 14, 18, although in other embodiments, the hooks 122 may be positioned elsewhere on the inner surface 120. As shown in FIG. 4, the hooks 122 extend towards an interior and a lower end of the housing 14, 18. In the illustrated embodiment, the hooks 122 have a right angled bend.

Figure 5:
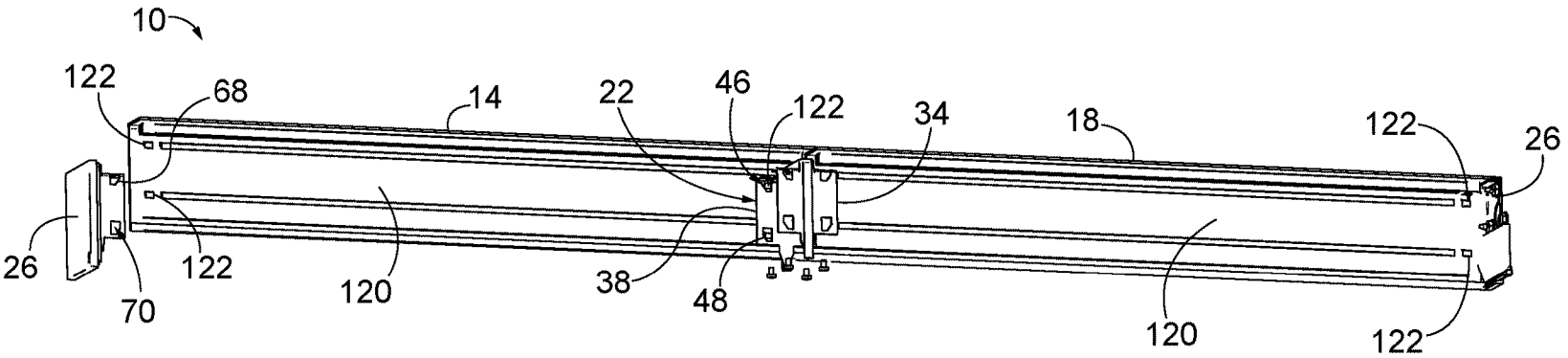
FIG. 5 is a cross-sectional view of the luminaire of FIG. 2 with housing portions coupled together, viewed along section 3-3.

As shown in FIG. 5, the central bracket 22 is positioned between the first housing 14 and the second housing 18 and the apertures 46 are aligned with the hooks 122. As the central bracket 22 moves toward an upper surface of the housings 14, 18, the inclined surfaces 48 pull the hooks 122 of the first housing 14 and the second housing 18 toward one another. The slope of the apertures 46 draws the hooks 122 toward the face axes 126, 130 (i.e., toward the center of the central bracket 22), and therefore biases the housings 14, 18 toward one another. Each aperture 46 mates with a respective hook 122 in order to couple the housings 14, 18 together.

The end bracket 26 is positioned proximate an end of either housing 14, 18 so that the apertures 70 are aligned with the hooks 122. Each aperture 70 mates with a respective hook 122 in order to couple the end bracket 26 to a housing 14, 18. In the illustrated embodiment, as the end bracket 26 is moved toward the upper surface of the housings 14, 18, the inclined surfaces pull the hooks 122 toward the surface 58 of the end bracket 26.

Figure 6:
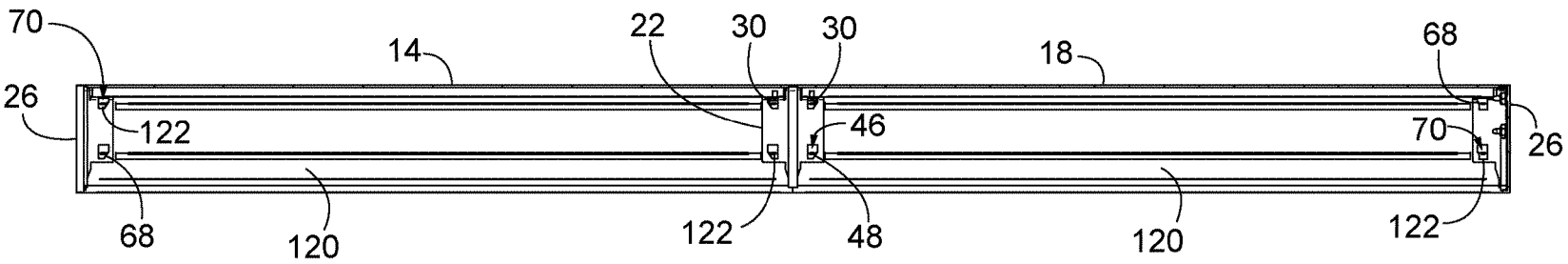
FIG. 6 is a cross-sectional view of the luminaire of FIG. 2 with housing portions coupled together, viewed along section 3-3.

As shown in FIG. 6, the fastening members 30 are inserted through the holes 54 (FIG. 8) to couple the central bracket 22 to the housings 14, 18. While not shown, fastening members are also inserted into holes 78 to couple the end bracket 26 to either the first housing 14 or the second housing 18.

The central bracket 22 creates a close connection between the first housing 14 and the second housing 18, providing a nearly seamless appearance. When the first housing 14 and the second housing 18 are connected, fasteners 30 are not visible on an external surface of either housing 14, 18. The bracket 22 also creates a seal that substantially limits water and other unwanted particles from entering through the interface between the housing portions 14, 18 and into the inner surface 120 of the housings 14, 18. The end bracket 26 also creates a seal that limits water and other unwanted particles from entering through the ends of the housings 14, 18.

The open area between the first face 34 and the second face 38 provides clearance to avoid interfering with internal lighting components (not shown). The same is true for the end bracket 26, which also does not extend substantially into the housing 14, 18.

Figure 10:
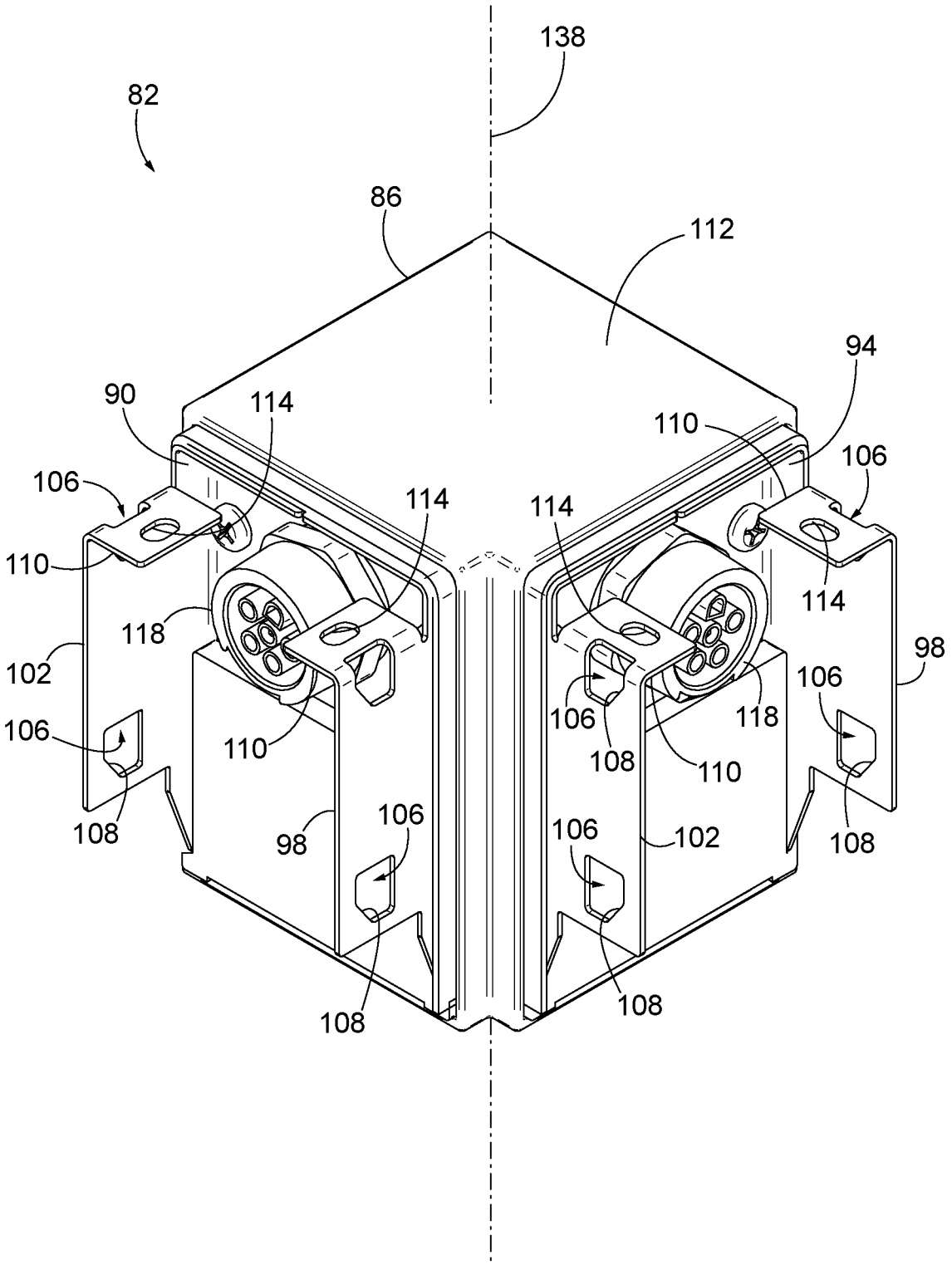
FIG. 10 is a perspective view of an intermediate coupler according to another embodiment.

As shown in FIG. 10, a second embodiment of an intermediate coupler or corner bracket 82 includes a body 86. In the illustrated embodiment, the body 86 has a rectangular profile, although in other embodiments, the body 86 may have a different shape. The body 86 is solid and includes a first connecting surface 90 and a second connecting surface 94. The first connecting surface 90 and the second connecting surface 94 are oriented orthogonally with respect to one another.

Each connecting surface 90, 94 includes a first planar portion or first side face 98 and a second planar portion or second side face 102 which are integrally formed on the connecting surfaces 90, 94 and extend orthogonally away from the connecting surfaces 90, 94. In some embodiments, the side faces 98, 102 are generally rectangular in shape.

In the illustrated embodiment, each side face 98, 102 includes two apertures 106. One aperture 106 is positioned on either end of each side face 98, 102, although in other embodiments, the apertures 106 may be positioned elsewhere on the side faces 98, 102. Each aperture 106 includes an inclined surface 108. In the illustrated embodiment, the inclined surfaces 108 slope downwardly, away from the top surface 112. Each inclined surface 108 slopes from an edge of the face 98, 102 distal the connecting surface 90, 94 and parallel to a central face or corner bracket axis 138, toward the corner bracket axis 138. In the illustrated embodiment, the oblique angle is between 0° and 90°, and the oblique portion 108 of the peripheral edge is neither parallel nor perpendicular relative to the adjacent portions of the peripheral edge, and is neither parallel nor perpendicular relative to the corner bracket axis 138. The apertures 106 on the respective first side faces 98 mirror the apertures 106 on the second side faces 102 about the corner bracket axis 138.

A bent section 110 is positioned adjacent an edge of the side face 98 and a bent section 110 is positioned adjacent an edge of the side face 102. The bent sections 110 are formed integrally with and positioned at an end of the side faces 98, 102. In the illustrated embodiment, the bent sections 110 are formed proximate the same end of the body 86. The bent sections 110 are oriented orthogonally to the side faces 98, 102 and extend towards the opposite side face 98, 102. In other words, the bent sections 110 on the first side face 98 and the bent sections 110 on the second side face 102 extend towards a center of the body 86. Each bent section 110 has one hole 114.

The connecting surfaces 90, 94 each include an electrical connector 118. In the illustrated embodiment, the electrical connector 118 has a circular shape and is positioned between the side faces 98, 102 and proximate the bent sections 110, although in other embodiments, the electrical connectors 118 may be positioned elsewhere on the connecting surfaces 90, 94.

Figure 7:
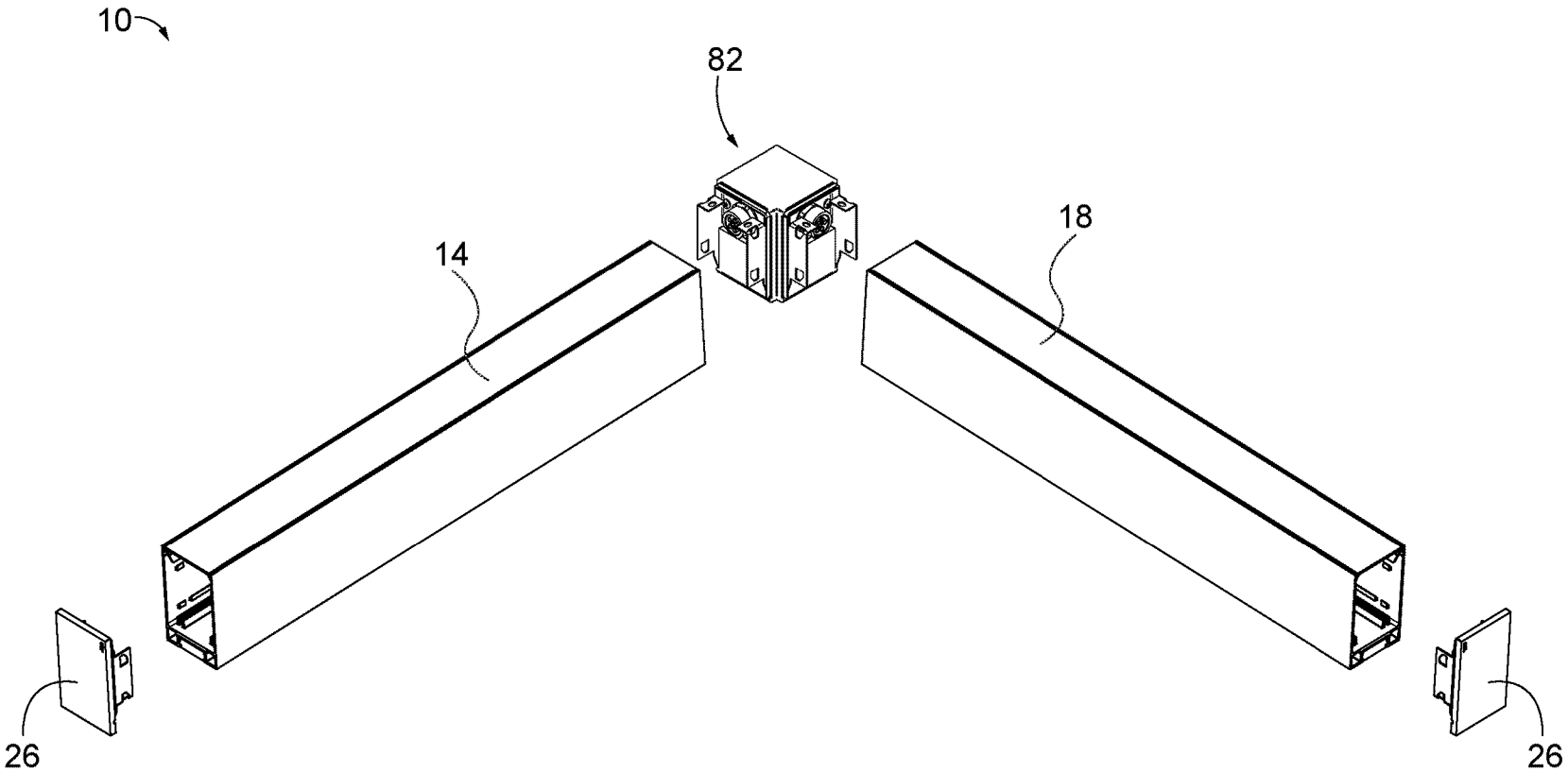
FIG. 7 is an exploded view of the luminaire housing according to another embodiment.

As shown in FIG. 7, the corner bracket 82 couples the first housing 14 and the second housing 18 in substantially the same manner as the central bracket 22. Instead of forming a continuous housing in a linear direction as the central bracket 22 does, the corner bracket 82 connects the housings 14, 18 at a right angle. The electrical connectors 118 (FIG. 10) provide electrical connection through the body 86 allowing the corner bracket 82 to create a seal between the housings 14, 18 while also providing electrical connection between the internal lighting components in the housings 14, 18.

Although aspects have been described in detail with reference to certain preferred embodiments, variations and modifications exist within the scope of one or more independent aspects as described.

What is claimed is:

1. A bracket removably connectable to a housing of a luminaire, the bracket comprising:

a first planar portion including at least one first aperture, the first aperture being enclosed within a first peripheral edge, an oblique portion of the first peripheral edge oriented at an oblique angle relative to at least one other portion of the first peripheral edge, the first aperture configured to receive a projection of the housing, engagement of the first projection along the oblique portion of the first peripheral edge biasing the bracket in a direction toward the housing;

a second planar portion parallel to the first planar portion, the second planar portion including at least one second aperture, the second aperture being enclosed within a second peripheral edge, an oblique portion of the second peripheral edge oriented at an oblique angle relative to at least one other portion of the second peripheral edge; and an intermediate portion coupled between the first planar portion and the second planar portion.

2. The bracket of claim 1, wherein the projection a first projection and the first aperture is configured to receive the first projection in an insertion direction and the second aperture is configured to receive a second projection in the insertion direction, wherein the oblique portion of the first peripheral edge and the oblique portion of the second peripheral edge are oriented at an acute angle relative to the insertion direction.

3. The bracket of claim 1, wherein the oblique portion of the peripheral edge of the aperture of the first planar portion is parallel to the oblique portion of the peripheral edge of the aperture of the second planar portion.

4. The bracket of claim 1, wherein the first planar portion and the second planar portion are configured to be coupled between two luminaire housings, the first planar portion including a first end, a second end, and a plurality of first apertures, one of the first apertures positioned adjacent the first end, another one of the first apertures positioned adjacent the second end, the second planar portion including a first end, a second end, and a plurality of second apertures, one of the second apertures positioned adjacent the first end, another one of the second apertures positioned adjacent the second end.

5. The bracket of claim 4, wherein an axis extends from one edge of the first planar portion to an opposite edge of the first planar portion, the axis positioned between the first end and the second end, wherein the oblique portion of the one of the first apertures positioned adjacent the first end and the oblique portion of the other of the first apertures positioned adjacent the second end are symmetric with respect to one another.

6. The bracket of claim 1, further comprising a third planar portion and a fourth planar portion parallel to the third planar portion, the third planar portion and the fourth planar portion oriented perpendicular relative to the first planar portion and the second planar portion, the third planar portion and the fourth planar portion each including an aperture, wherein the first planar portion and the second planar portion are configured to engage a first housing, wherein the third planar portion and the fourth planar portion are configured to engage a second housing.

7. The bracket of claim 1, further comprising an electrical connector positioned between the first and second planar portions, the electrical connector configured to provide electrical communication.

8. The bracket of claim 1, wherein the at least one first aperture of the first planar portion includes a plurality of first apertures, wherein the at least one second aperture of the second planar portion includes a plurality of second apertures.

9. The bracket of claim 1, wherein the first planar portion includes a first end and a second end, wherein the second planar portion includes a first end and a second end, wherein the intermediate portion extends laterally between the first planar portion and the second planar portion, the intermediate portion connected to the first planar portion between the first end and the second end, the intermediate portion connected to the second planar portion between the first end and the second end.

10. The bracket of claim 1, wherein the intermediate portion is an end cap, wherein the first planar portion and the second planar portion extend from the end cap.

11. A luminaire comprising:

a housing including an end and an inner surface;

a bracket positioned adjacent the end of the housing;

a projection positioned on one of the inner surface of the housing and the bracket; and an aperture positioned on the other of the inner surface of the housing and the bracket, the aperture receiving the projection, the aperture being enclosed within a peripheral edge, an oblique portion of the peripheral edge oriented at an oblique angle relative to at least one other portion of the peripheral edge, the oblique portion engaging the projection to bias the bracket toward the end of the housing.

12. The luminaire of claim 11, wherein the aperture is configured to receive the projection in an insertion direction, wherein the oblique portion is oriented at an acute angle relative to the insertion direction.

13. The luminaire of claim 11, wherein the housing is a first housing, the luminaire further including a second housing having an end and an inner surface, wherein the bracket is positioned adjacent the end of the second housing, further comprising a second projection and a second aperture, the second projection positioned on one of the inner surface of the second housing and the bracket, the second aperture positioned on the other of the inner surface of the second housing and the bracket, the second aperture receiving the second projection, the bracket coupling the second housing to the first housing.

14. The luminaire of claim 11, wherein the bracket includes a first planar portion, a second planar portion, and an intermediate portion extending therebetween, wherein the aperture is a first aperture and the projection is a first projection, wherein the first aperture is positioned on the first planar portion and the second aperture is positioned on the second planar portion.

15. The luminaire of claim 14, wherein the bracket further includes a third planar portion and a fourth planar portion parallel to the third planar portion, the third planar portion and the fourth planar portion oriented perpendicular relative to the first planar portion and the second planar portion, the third planar portion including a third aperture and the fourth planar portion including a fourth aperture, wherein the housing is a first housing and the luminaire further includes a second housing, the first planar portion and the second planar portion are coupled to the first housing, the third planar portion and the fourth planar portion are coupled to the second housing.

16. The luminaire of claim 11, further comprising an electrical connector positioned between the first and second planar portions, the electrical connector configured to provide electrical communication.

17. The luminaire of claim 11, wherein the intermediate portion is an end cap, wherein the first planar portion and the second planar portion extend from the end cap.

18. The luminaire of claim 11, wherein the bracket including a planar portion and a bend positioned along an edge of the planar portion, the bend including a hole configured to receive a fastening member to couple the bracket to the housing.

19. The luminaire of claim 11, wherein the bracket sealingly engages the housing.

20. The luminaire of claim 11, wherein the bracket includes a planar portion having a first end and a second end, wherein the aperture is a first aperture positioned adjacent the first end, the luminaire further comprising a second aperture positioned adjacent the second end of the planar portion, the second aperture receiving a second projection of a second housing, the second aperture being enclosed within a second peripheral edge, an oblique portion of the second peripheral edge oriented at an oblique angle relative to at least one other portion of the second peripheral edge, the oblique portion engaging the second projection to bias the bracket toward the end of the second housing, wherein an axis extends from one edge of the planar portion to an opposite edge of the planar portion, the axis positioned between the first end and the second end, wherein the oblique portion of the first aperture and the oblique portion of the second aperture are symmetric with respect to one another.

* * * * *